US009335723B2

(12) United States Patent
So et al.

(10) Patent No.: US 9,335,723 B2
(45) Date of Patent: May 10, 2016

(54) IMAGE FORMING APPARATUS AND CONTAINER MOUNTING GROOVE THEREOF

(71) Applicant: Samsung Electronics Co., Ltd., Suwon-si (KR)

(72) Inventors: Kwang-hyuck So, Seoul (KR); Young-soo Ko, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/306,939

(22) Filed: Jun. 17, 2014

(65) Prior Publication Data

US 2015/0063874 A1 Mar. 5, 2015

(30) Foreign Application Priority Data

Sep. 2, 2013 (KR) ..... 10-2013-0104827
Oct. 31, 2013 (KR) ..... 10-2013-0130984

(51) Int. Cl.
*G03G 15/08* (2006.01)
*G03G 21/16* (2006.01)

(52) U.S. Cl.
CPC ..... *G03G 21/1676* (2013.01); *G03G 15/087* (2013.01)

(58) Field of Classification Search
USPC ..... 399/9, 12, 13, 107–110, 119, 120, 252, 399/258–263
See application file for complete search history.

(56) References Cited

U.S. PATENT DOCUMENTS 5,530,531 A 6/1996 Girard
7,272,336 B1 * 9/2007 Dawson ..... G03G 21/1652 399/119
7,869,739 B2 1/2011 Mashtare et al.
2011/0243579 A1 * 10/2011 Oshikawa et al. ..... 399/12

FOREIGN PATENT DOCUMENTS

JP 2007-168134 7/2007

OTHER PUBLICATIONS

Internet Blog <<http://blog.naver.com/PostPrint.nhn?blogId=jhoony71&logNo=80127517740>> of Dec. 31, 2013 commenting on Fuji Xerox, "Smart and powerful mono laser printer—Fuji Xerox printer's DocuPrint P205b", Apr. 4, 2011, 14 pp.

* cited by examiner

*Primary Examiner* — Hoan Tran
(74) *Attorney, Agent, or Firm* — Staas & Halsey LLP

(57) ABSTRACT

An image forming apparatus is provided, which includes an image forming apparatus main body, and first and second toner containers mounted in the image forming apparatus main body, wherein the first and second toner containers are respectively mounted in first and second toner container mounting grooves that are concavely formed from a housing portion of the image forming apparatus main body.

20 Claims, 19 Drawing Sheets

300

IMAGE FORMING APPARATUS AND CONTAINER MOUNTING GROOVE THEREOF

CROSS-REFERENCE TO RELATED APPLICATIONS

This application is related to, and claims priority benefit to, Korean Patent Application No. 10-2013-0104827, filed on Sep. 2, 2013, and Korean Patent Application No. 10-2013-0130984, filed on Oct. 31, 2013, in the Korean Intellectual Property Office, the disclosures of which are incorporated herein by reference.

BACKGROUND

1. Field

Exemplary embodiments relate to an image forming apparatus, and more particularly to an image forming apparatus to which a bottle type toner container is applied.

2. Description of the Related Art

For paper printing, a method may be applied, which develops an electrostatic latent image, which is formed by scanning a photoconductor (e.g., photosensitive drum) with laser light, into a toner image and transfers the toner image onto a printing paper directly or using a transfer belt.

In an image forming apparatus, such as a laser printer, adopting such a printing method, a toner supply device for supplying toner to an image forming apparatus main body may be replaceably mounted in the form of expendable supplies.

A typical toner supply device may be mounted inside the main body after a part of an external housing of the image forming apparatus main body is opened. Accordingly, it may be difficult to confirm whether the toner supply device is mounted without opening the external housing, and replacement work of the toner supply device may be cumbersome due to the opening/closing of the external housing.

SUMMARY

Additional aspects and/or advantages will be set forth in part in the description which follows and, in part, will be apparent from the description, or may be learned by practice of the invention.

An exemplary embodiment addresses the above problems and/or disadvantages and provides the advantages described below. Accordingly, an aspect of an exemplary embodiment provides an image forming apparatus, which makes it possible to easily confirm whether a toner supply device is mounted and to conveniently perform the replacement work of the toner supply device.

According to an aspect of the present disclosure, an image forming apparatus includes an image forming apparatus main body, and first and second toner containers mounted in the image forming apparatus main body, wherein the first and second toner containers are respectively mounted in first and second toner container mounting grooves that are concavely formed in a housing portion of the image forming apparatus main body.

A color of toner accommodated in the first toner container may be different from a color of toner accommodated in the second toner container.

The toner accommodated in the first toner container may be a toner of a black color, and the toner accommodated in the second toner may be a toner of a highlight color.

The toner containers may be bottle-shaped. The first toner container mounting groove and the second toner container mounting groove may be arranged in parallel to be spaced apart from each other.

Each of the toner containers may be mounted in each of the toner container mounting grooves so that at least a part of the toner container is exposed out of the image forming apparatus main body.

Each of the toner container mounting grooves are formed in an upper housing portion of the image forming apparatus main body and may extend vertically downward from the upper housing portion.

The upper housing portion of the image forming apparatus main body may include first and second toner container mounting portions having the first and second toner container mounting grooves, respectively, and each of the toner container mounting portions may include a bottom surface portion having at least one toner outflow hole; and a vertical extension portion configured to vertically extend from the bottom surface portion toward the upper housing portion of the image forming apparatus main body.

Each of the toner containers may include a container body on which at least one toner discharge hole is formed, and a shutter member mounted in the container body so as to be arranged in a first position to close the toner discharge hole or in a second position to open the toner discharge hole.

The shutter member may be slidable between the first position and the second position in the container body.

Each of the toner containers may further include an elastic pressing member configured to elastically press the shutter member in the first direction, and the bottom surface portion of the toner container mounting portion may have a pressing projection configured to press the shutter member in the second direction when the corresponding toner container is mounted.

The shutter member may include a plate-shaped shutter portion configured to close the toner discharge hole when the shutter member is arranged in the first position, an elastic member support portion formed to project from an upper surface of the shutter portion to support the elastic pressing member, and a pressed portion formed to project from a lower surface of the shutter portion to be pressed by the pressing projection when the toner container is mounted.

The container body may be mounted on the toner container mounting portion to be bidirectionally rotatable in a predetermined angle range, and an arrangement of the shutter member may be shifted from the first position to the second position by a forward rotation of the container body, and may be shifted from the second position to the first direction by a reverse rotation of the container body.

At least one toner discharge hole may be formed on a bottom surface portion of the container body, and at least one shutter hole, which is arranged corresponding to the at least one toner discharge hole in the second position, may be formed on the shutter member.

At least one fixing projection for fixing the shutter member may be provided on the toner container mounting portion, and at least one fixing groove, into which the fixing projection is inserted, may be formed on a bottom surface of the shutter member.

The fixing projection may be elastically supported upward by an elastic support member provided on the toner container mounting portion.

A screw projection may be formed on a bottom surface portion of the container body, and a screw hole that is screw-fastened to the screw projection may be formed on the shutter member.

At least one rotary projection may be formed on a side surface portion of the container body, and at least one rotary guide groove that guides rotation of the rotary projection may be formed on an inner side surface of the toner container mounting portion.

At least one vertical guide groove may be formed on an inner side surface of the vertical extension portion to guide the rotary projection from the upper housing portion to the rotary guide groove when the toner container is mounted.

A cover member for covering the first and second toner containers may be openably mounted in the image forming apparatus main body.

The cover member may be formed of a transparent or semi-transparent material.

BRIEF DESCRIPTION OF THE DRAWINGS

The above and other aspects, features and advantages of an exemplary embodiment will be more apparent from the following detailed description when taken in conjunction with the accompanying drawings, in which:

FIGS. 12A and 12B are cross-sectional views taken along line II-II of FIG. 10, in which FIG. 12A illustrates an exemplary state where insertion of a toner container is completed in a process of mounting the toner container on an image forming apparatus main body, and FIG. 12B illustrates an exemplary state where rotation of a toner container is completed in the process of mounting the toner container on the image forming apparatus main body;

DETAILED DESCRIPTION

Figure 1:
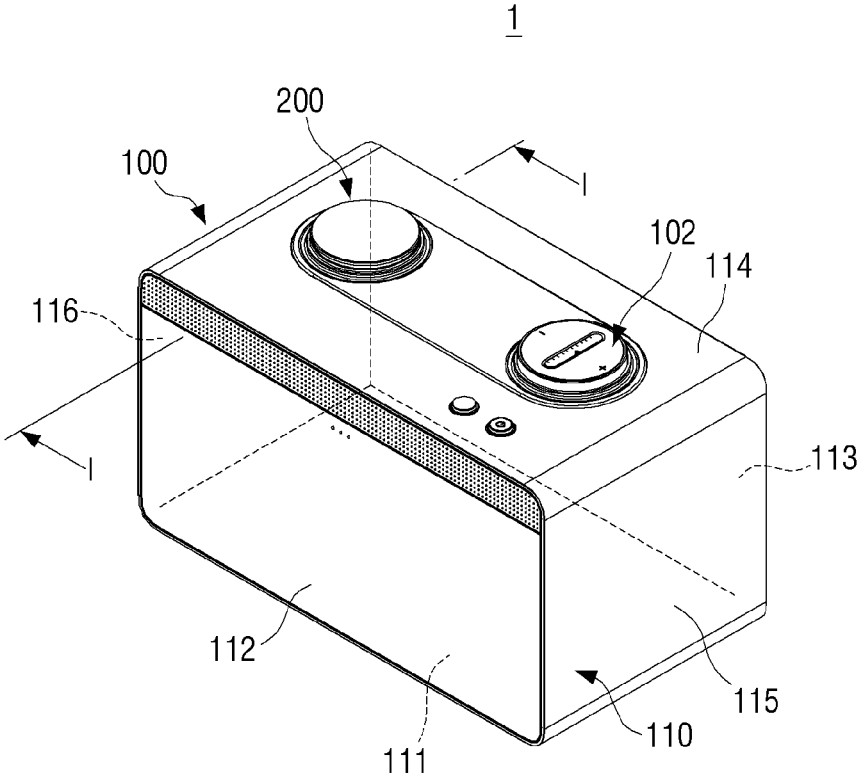
FIG. 1 is a perspective view of an image forming apparatus according to an embodiment.

Reference will now be made in detail to the embodiments, examples of which are illustrated in the accompanying drawings, wherein like reference numerals refer to the like elements throughout. The embodiments are described below to explain the present invention by referring to the figures.

Exemplary embodiments are described in detail with reference to the accompanying drawings.

Figure 2:
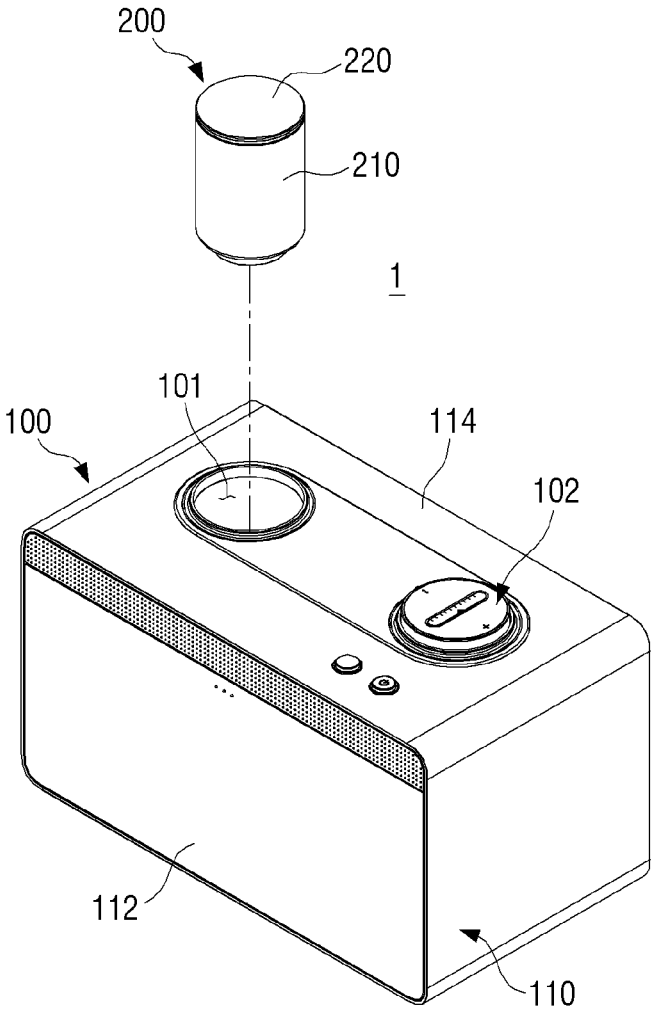
FIG. 2 is a perspective view illustrating an exemplary image forming apparatus in a state where a toner container is separated from the image forming apparatus.

FIG. 1 is a perspective view of an image forming apparatus according to an embodiment. FIG. 2 is a perspective view illustrating an image forming apparatus in a state where a toner container is separated from the image forming apparatus, and FIG. 3 is an exemplary cross-sectional view taken along line I-I of FIG. 1.

Figure 3:
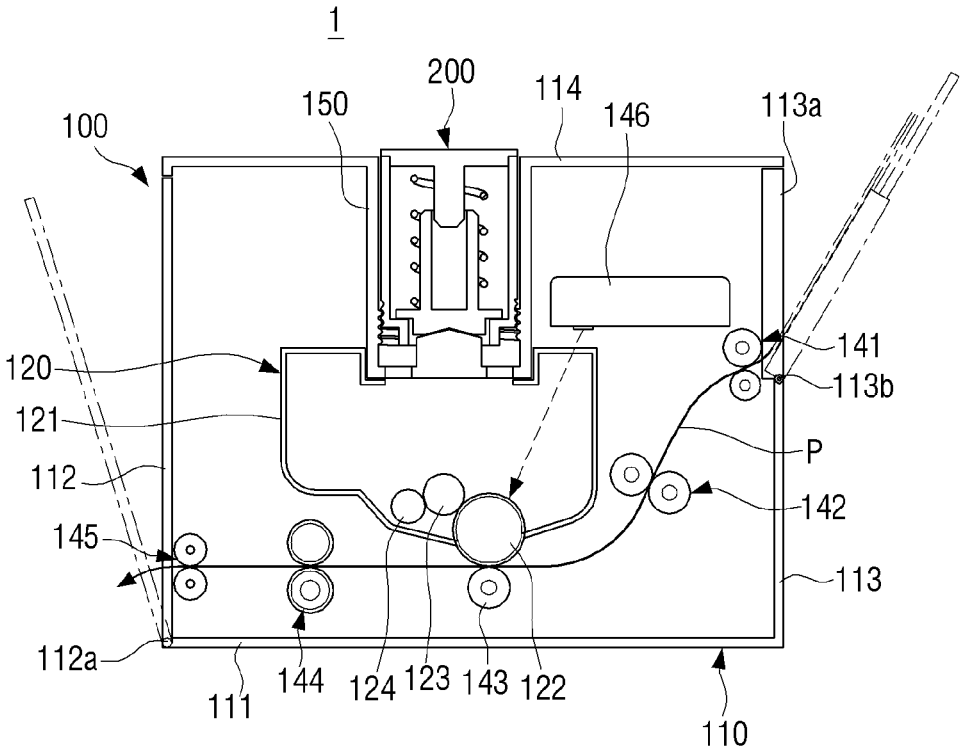
FIG. 3 is an exemplary cross-sectional view taken along line I-I of FIG. 1.

Referring to FIGS. 1 to 3, an image forming apparatus 1 according to an embodiment is a small monochrome laser printer, and includes a main body 100 and a toner container 200 that may be separably mounted in the main body 100.

The image forming apparatus main body 100 has an external housing 110 that accommodates a plurality of internal components and forms an external appearance of the image forming apparatus 1. The external housing 110 includes bottom and upper housing portions 111 and 114, e.g., facing each other to form a bottom surface and an upper surface of the image forming apparatus 1, front and rear housing portions 112 and 113, e.g., facing each other to form a front surface and a rear surface of the image forming apparatus 1, and right and left housing portions 115 and 116, e.g., facing each other to form a right surface and a left surface of the image forming apparatus 1. The external housing 110 of the image forming apparatus main body 100 may be in a cuboidal shape.

As illustrated in FIG. 1, a sound emission portion 118 having a plurality of sound emission holes may be formed in the front housing portion 112. As illustrated in FIG. 3, a speaker unit 160 that can provide sound, such as alarm or music, through the sound emission portion 118 may be provided in the image forming apparatus main body 100. As illustrated in FIG. 1, a USB port 119 may be provided on the right housing portion 115. Alternatively, the USB port 119 may be provided on the left housing portion 116 or the rear housing portion 113. In a case where an external appliance, such as a smart phone or a personal computer (PC), is connected to the USB port 119 through a USB cable, the image forming apparatus may function as not only a printer which outputs image data that is provided from the external appliance connected to the USB port, but also as a speaker which outputs sound data that is provided from the connected external appliance.

Referring to FIG. 3, a paper feeder door 113*a* for feeding printing papers into the main body 100 may be provided on the rear housing portion 113. The paper feeder door 113*a* may be rotatably engaged with the rear housing portion 113 by a hinge 113*b*. Accordingly, during a printing job, the paper feeder door 113*a* may be opened by a user to be inclined with respect to the rear housing portion 113, and thus the printing papers may be supplied into the main body 100.

Referring to FIG. 3, the front housing portion 112 may be rotatably engaged with the bottom housing portion 111 by a hinge 112*a*. Accordingly, during a printing job, the front housing portion 112 may be opened by a user to be arranged in parallel to the bottom housing portion 111. Accordingly, printed papers may be sequentially loaded on the front housing portion 112 that is spread in parallel to the bottom housing 111.

Referring to FIG. 2, a toner amount indicating unit 102 that indicates the residual toner amount of the toner container 200, e.g., in analog may be mounted on the upper housing portion 114. The toner amount indicating unit 102 may be arranged in parallel to the toner container 200 at a distance. According to an embodiment, scale indicators of the toner amount indication unit 102 may be arranged up and down, and as an alternative, the scale indicators of the toner amount indication unit 102 may be arranged in a circular shape, e.g., like speed scale indicators of a vehicle. A user can easily confirm the residual toner amount in the toner container 200 through the toner amount indication unit 102 without a computer monitor that may be connected to the image forming apparatus 1.

Referring to FIGS. 1 and 2, the toner container 200 may be a bottle shape. A "bottle" may be defined as one of various types of containers, which has an inlet port formed on an upper end portion thereof and an accommodation space formed therein and connected to the inlet port. According to an embodiment, the toner container 200 has a circular cross-section. The toner container 200 may have various cross-sectional shapes, such as elliptical cross-section and rectangular cross-section.

A monochrome (e.g., black) toner may be accommodated in the inside of the toner container 200. A toner container mounting groove 101, which is concavely formed from the upper housing portion 114, is provided on the main body 100, and the toner container 200 is mounted in the toner container mounting groove 101. Accordingly, toner that is accommodated in the toner container 200 may be supplied into the main body 100.

A toner container mounting groove 101 may be formed on a side surface portion of the main body 100, such as the left housing portion 115 or the right housing portion 116. However, in order for a user to mount the toner container 200 in the toner container mounting groove 101 more easily, according to an embodiment, a toner container mounting groove 101 may be formed on the upper housing portion 114 of the main body 100.

The toner container mounting groove 101 extends vertically downward from the upper housing portion 114. Accordingly, the toner container 200 that is mounted in the toner container mounting groove 101 may be arranged in the vertical direction, and the toner accommodated in the toner container 200 can be smoothly discharged out of the toner container 200 with the help of gravity. Further, since the toner container mounting groove 101 is not hidden by the external housing 110, but is exposed to outside, any separate work, such as opening of the external casing 110, is not necessary when the toner container 200 is replaced. Accordingly, the replacement work of the toner container 200 can be easily performed.

FIGS. 1 and 2 illustrate one toner container 200, but another toner container (not illustrated) that is a different size, e.g., longer than the toner container 200 may be used. That is, in accordance with a user's selection, one of the plurality of toner containers, e.g., two toner containers having different capacities may be mounted in the main body 100. Since the toner container 200 may be mounted in the main body 100 so that an upper end portion thereof is exposed to outside, a user can confirm which toner container is mounted in the main body 100 even without seeing the inside of the main body 100.

Referring to FIG. 3, components, such as a development unit 120, a pickup unit 141, one or more conveyor unit 142, a transfer roller 143, a fixing unit 144, a discharge unit 145, and an exposure unit 146, etc., may be accommodated inside the main body 100. A development unit 120 includes a development unit casing 121, a photosensitive drum 122 accommodated in the casing, a development roller 123, and a supply roller 124. The components may be accommodated in the main body 100.

A printing process that is performed by the image forming apparatus 1 along a paper path P is described. If a print job starts, an electrostatic latent image that reflects print data may be formed on the photosensitive drum 122 by laser light provided from the exposure unit 146, and the electrostatic latent image is developed into a toner image by the development roller 123. The printing paper may be picked up by the pickup unit 141, and passes between the photosensitive drum 122 and the transfer roller 143 to receive a transfer of the toner image that is formed on the photosensitive drum 122. The printing paper is discharged out of the main body 100 by the discharge unit 145 after passing through an image fixing process that is performed by the fixing unit 144.

Referring to FIG. 3, a toner container mounting portion 150 having the toner container mounting groove 101 (see FIG. 2) may be provided in the upper housing portion 114 of the main body 100. The toner container mounting portion 150 vertically extends from the upper housing portion 114 into the main body 100, and communicates with the development unit casing 121. Accordingly, if mounting of the toner container 200 in the toner container mounting portion 150 is completed, toner that is discharged from the toner container 200 may be supplied into the development unit 120 through the toner container mounting portion 150. The toner container mounting portion 150 may be configured to form a part of the upper housing portion 114, and as an alternative, the toner container mounting portion 150 may be configured to form a part of the development unit casing 121.

Referring to FIGS. 4, 5, 6A, and 6B, the toner container 200 and the toner container casing 121 are described.

Figure 4:
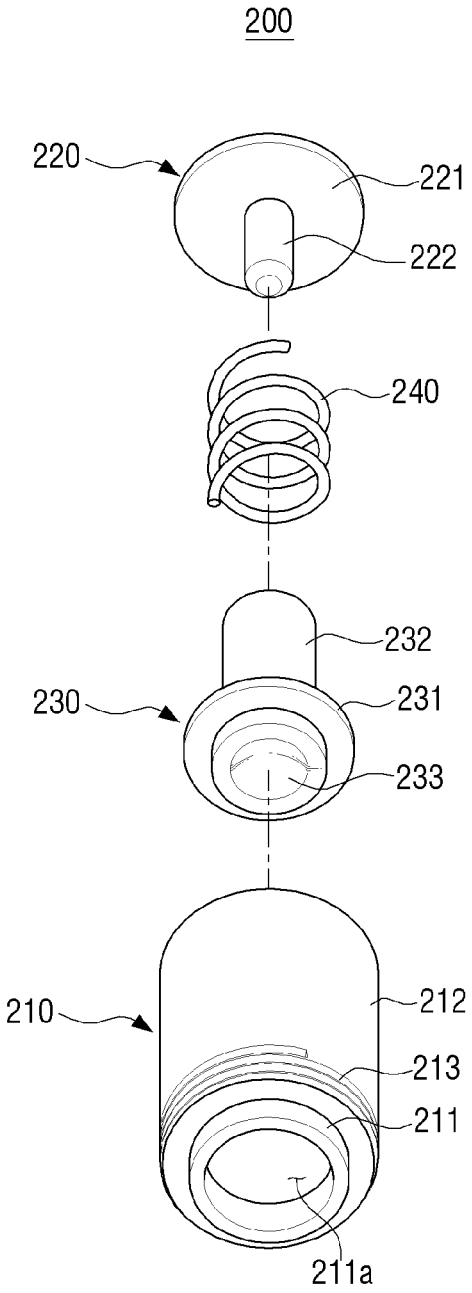
FIG. 4 is an exploded perspective view of an exemplary toner container provided in an image forming apparatus.
Figure 5:
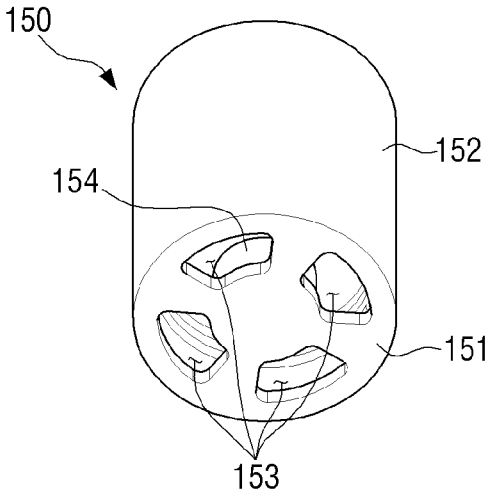
FIG. 5 is a perspective view of an exemplary container mounting portion provided in an image forming apparatus.
Figure 6A:
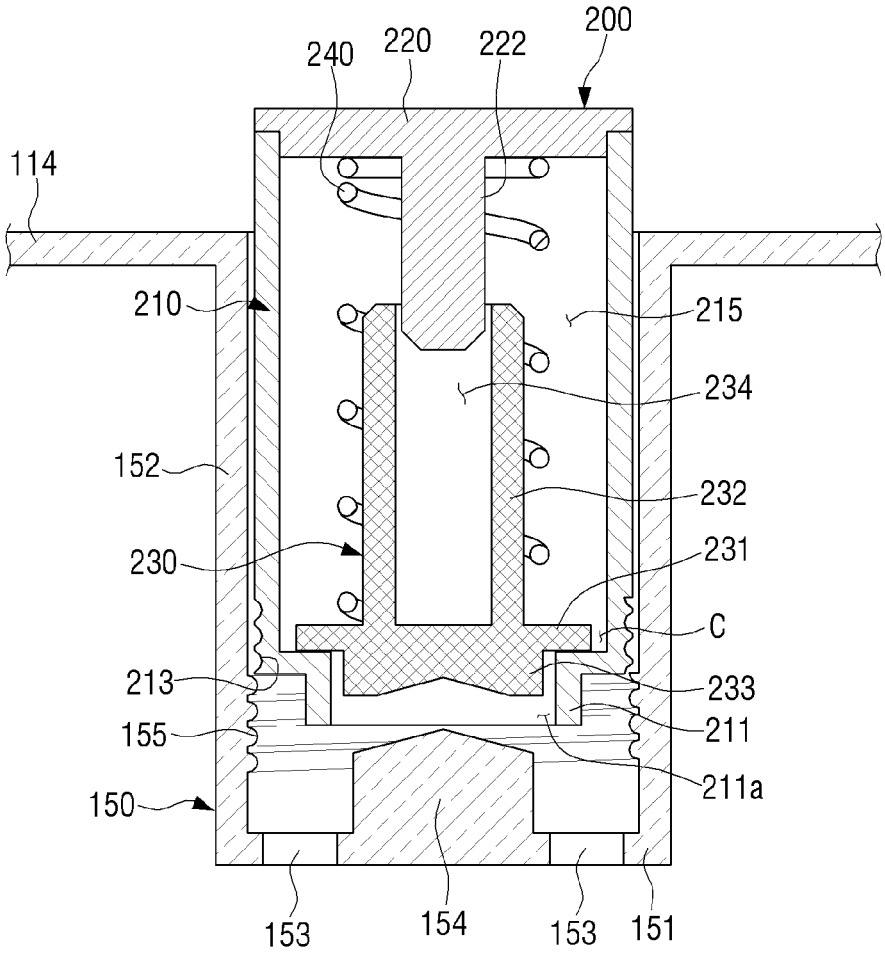
FIGS. 6A and 6B are views illustrating exemplary sequential processes for inserting a toner container into a toner container mounting portion.
Figure 6B:
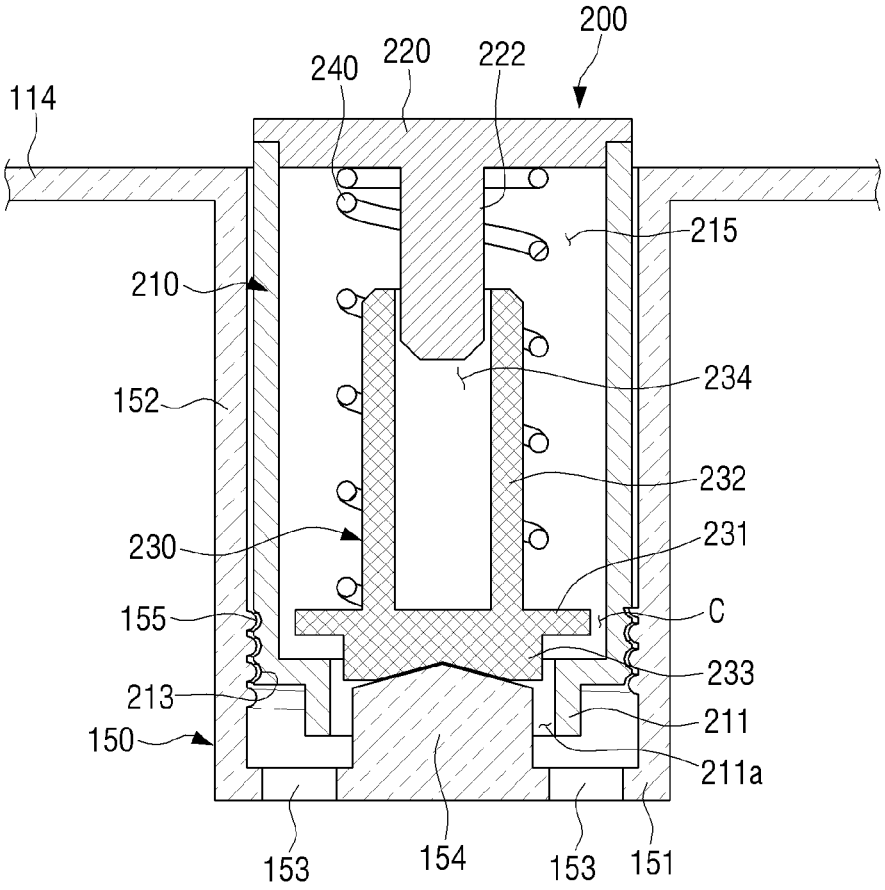

FIG. 4 is an exploded perspective view of a toner container provided in an image forming apparatus, and FIG. 5 is a perspective view of a container mounting portion provided in an image forming apparatus. FIGS. 6A and 6B are views illustrating processes, e.g., sequential processes for inserting a toner container into a toner container mounting portion.

Referring to FIGS. 4 and 6A, the toner container 200 includes a container body 210, a cap member 220, a shutter member 230, and an elastic pressing member 240.

The container body 210 may be a cylindrical shape, and have a toner accommodation space 215 therein. A toner discharge hole 211*a* may be formed at a lower end portion 211 of the container body 210, and a female screw thread 213 is formed on a side surface portion 212 of the container body 210 with a specific width.

The cap member 220 may be engaged with an upper end portion of the container body 210 to prevent the toner in the toner container 200 from flowing through an upper portion of the toner container 200. The cap member 220 includes a cap portion 221 that closes the upper end portion of the container body 210 and a shutter guide projection 222 projecting from a bottom surface of the cap portion 221.

The shutter member 230 includes a shutter portion 231 having, for example, a circular plate shape, an elastic member support portion 232 formed to project from an upper surface of the shutter portion 231, and a pressed portion 233 formed to project from a bottom surface of the shutter portion 231.

The shutter portion 231 is a portion that may serve to open/close the toner discharge hole 211*a* that is formed on the container body 210. As illustrated in FIG. 6A, the diameter of the shutter portion 231 may be smaller than the inner diameter of the container body 210. Accordingly, a gap C for toner movement may be present between the shutter portion 231 and the container body 210.

The elastic member support portion 232 may be inserted into the elastic pressing member 240 and supports the elastic pressing member 240 so that the elastic pressing member 240 is kept between the cap portion 221 and the shutter portion 231. A shutter guide groove 234, into which the shutter guide projection 222 of the cap member 220 is inserted, may be formed in the elastic member support portion 232. Since the shutter guide projection 222 may be inserted into the shutter guide hole 234, upward/downward movement of the shutter member 230 can be accurately performed.

The pressed portion 233 is a portion that may be pressed by a pressing projection 154 (see, for example, FIG. 6A) of the toner container mounting portion 150 when the toner container 200 is mounted in the toner container mounting portion 150.

The elastic pressing member 240 elastically presses the shutter member 230 downward. According to an embodiment, the elastic pressing member 240 comprises a coil spring arranged between the cap portion 221 of the cap member 220 and the shutter portion 231 of the shutter member 230. The elastic pressing member 240 may be supported by the elastic member support portion 232 of the shutter member 230.

Referring to FIGS. 5 and 6A, the toner container mounting portion 150 includes a bottom surface portion 151 having a plurality of toner outflow holes 153 formed thereon, and a vertical extension portion 152 vertically extending from the bottom surface portion 151 toward the upper housing portion 114 of the image forming apparatus main body 100.

According to an embodiment, a plurality of holes, e.g., four toner outflow holes 153 may be formed on the bottom surface portion 151, and the number of toner outflow holes 153 may be variously changed according to embodiments. The pressing projection 154 may be formed to project from an inner surface of the bottom surface portion 151. When the toner container 200 is mounted in the main body 100, the shutter member 230 may be pressed upward by the pressing projection 154, and thus the toner discharge hole 211*a* of the toner container 200 is opened. A male screw thread 155 that corresponds to the female screw thread 213 is formed on an inner side surface of the vertical extension portion 152.

Mounting of the toner container 200 may be performed by inserting the toner container 200 into the toner container mounting portion 150 of the main body 100 and opening the toner discharge hole 211*a* through rotating of the toner container 200.

FIG. 6A illustrates exemplary shapes of the toner container 200 and the toner container mounting portion 150 after the toner container insertion is completed, and FIG. 6B illustrates the shapes of the toner container 200 and the toner container mounting portion 150 after the stoner container rotation is completed.

Referring to FIG. 6A, even after the toner container insertion is performed, the shutter member 230 may be still kept in a first position (closed position) to close the toner discharge hole 211*a* by an elastic force that is provided by the elastic pressing member 240. In this case, the pressing projection 154 of the toner container mounting portion 150 may not come in contact with the shutter member 230. Since the toner discharge hole 211*a* is still kept in the closed state even after the toner container insertion is performed, the toner is not discharged from the toner container 200.

Referring to FIG. 6B, as the toner container 220 is rotated in a first direction (forward direction) in the toner container rotation, the female screw thread 213 of the toner container 200 may be fastened to the male screw thread 155 of the toner container mounting portion 150, and thus the toner container 200 further enters into the lower portion of the toner container mounting portion 150. The shutter member 230 may be pressed by the pressing projection 154 of the toner container mounting portion 150, and thus may be arranged in the second position (open position) to open the toner discharge hole 211*a* of the container body 210. Accordingly, if the toner container rotation is completed, as illustrated in FIG. 6B, the toner discharge hole 211*a* of the toner container 200 may be kept in an open state, and thus the toner accommodated in the toner container 200 can be supplied into the development unit 120 through the toner discharge hole 211*a* of the toner container 200 and the toner outflow hole 153 of the toner container mounting portion 150.

The process of separating the toner container 200 from the image forming apparatus main body 100 may be performed in reverse to the process of mounting the toner container 200. By rotating the toner container 200 in a second direction (reverse direction), the engagement between the screw threads 213 and 155 and the pressing of the shutter member 230 by the pressing projection 154 are released. Since the pressing of the pressing projection 154 is released as illustrated in FIG. 6A, the shutter member 230 returns to the first position to close the toner discharge hole 211*a* by the elastic force of the elastic pressing member 240. The toner container 200 is taken out of the toner container mounting portion 150 to complete the separation work of the toner container 200.

Since the toner container 200 may be separated from the toner container mounting portion 150 after the toner discharge hole 211*a* is closed by the shutter member 230, the image forming apparatus main body 100 or a user's hand may be prevented from getting dirty due to the residual toner in the toner container 200 during a replacement work of the toner container 200.

In the image forming apparatus main body 100, a second type toner container 300 may be mounted to be used as an alternative of the toner container 200 as described above. An exemplary toner container 300 is described with reference to FIGS. 7 to 11, 12A, and 12B.

First FIGS. 7 to 11 are referred to.

Figure 7:
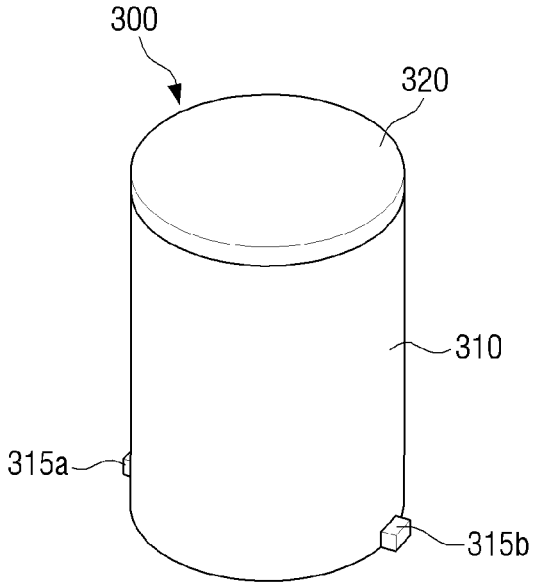
FIG. 7 is a perspective view of an exemplary toner container that can be mounted in a main body of an image forming apparatus.
Figure 8:
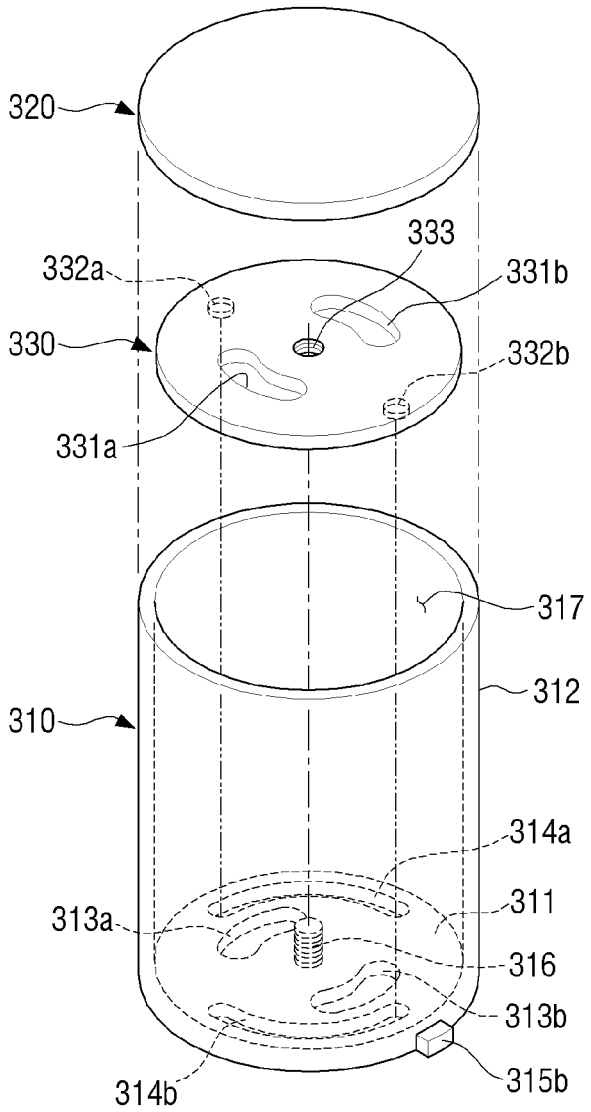
FIG. 8 is an exploded perspective view illustrating an exemplary toner container.
Figure 9:
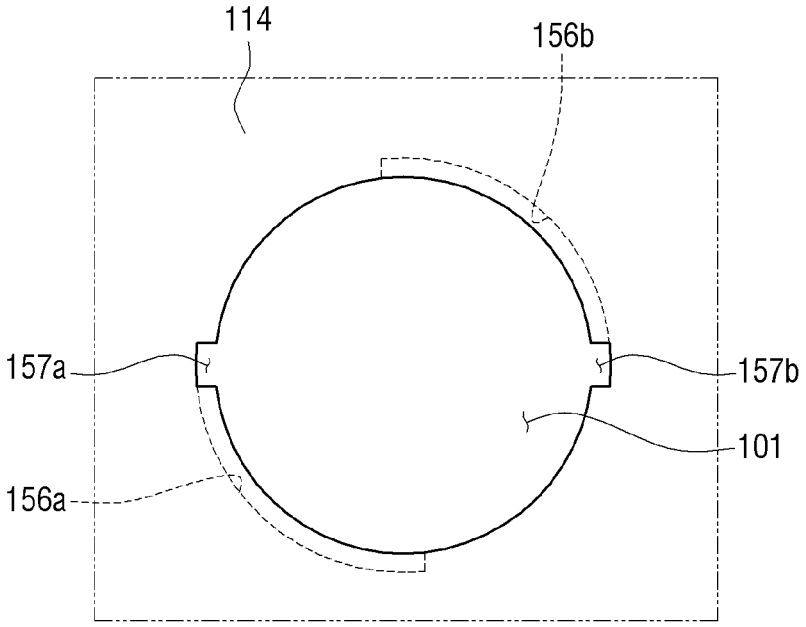
FIG. 9 is a plan view illustrating the vicinity of an exemplary toner container mounting groove of a main body of an image forming apparatus in which a toner container is mounted.
Figure 10:
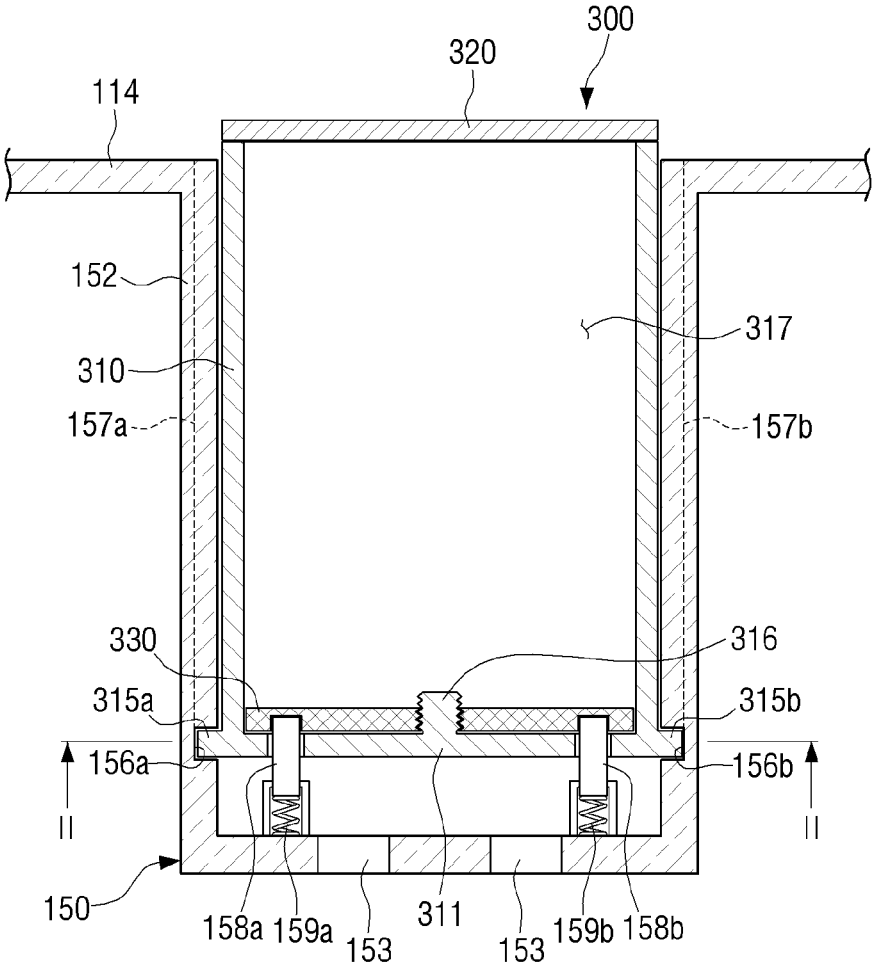
FIG. 10 is a partial cross-sectional view of an exemplary image forming apparatus on which a toner container is mounted.
Figure 11:
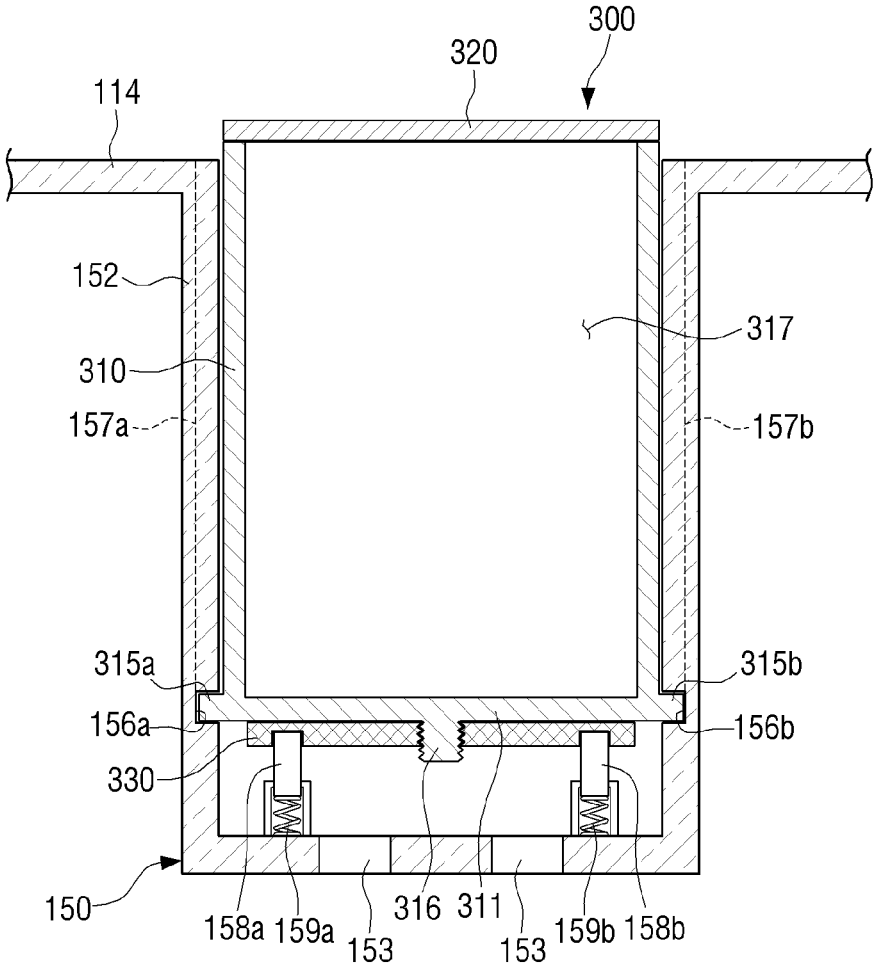
FIG. 11 is a partial cross-sectional view illustrating an exemplary arrangement of a shutter member.

FIG. 7 is a perspective view of an exemplary toner container that can be mounted in a main body of a image forming apparatus. FIG. 8 is an exploded perspective view illustrating a toner container, and FIG. 9 is a plan view illustrating a vicinity of a toner container mounting groove of an image forming apparatus main body in which a toner container may be mounted. FIG. 10 is a partial cross-sectional view of an image forming apparatus on which a toner container may be mounted, and FIG. 11 is a cross-sectional view similar to FIG. 10 explaining an exemplary arrangement of a shutter member.

A toner container 300 includes a container body, e.g., a cylinder-shaped container body 310 having a toner accommodation space 317, a cap member 320 engaged with an upper end of the container body 310, and a shutter member 330 engaged with a bottom surface portion 311 of the container body 310.

The container body 310 includes a bottom surface portion 311 having, for example, a circular plate shape and a side surface portion 312 vertically extending from the edge of the bottom surface portion 311 to an upper portion of the container body 310. A screw projection 316 that projects upward is formed in the center of the bottom surface portion 311. First and second toner discharge holes 313*a* and 313*b* and first and second fixing projection through-holes 314*a* and 314*b* may be formed on the bottom surface portion 311. First and second rotary projections 315*a* and 315*b* may be formed at a lowermost end portion of the side surface portion 312. According to an embodiment, two rotary projections 315*a* and 315*b* are provided, but in alternative embodiments, the number of rotary projections may be changed to a different number, for example, to one or three.

As illustrated in FIGS. 9 and 10, first and second rotary guide grooves 156*a* and 156*b*, which guide rotation of the first and second rotary projections 315*a* and 315*b* may be formed on an inner side surface of a vertical extension portion 152 of a toner container mounting portion 150, and first and second vertical guide grooves 157*a* and 157*b*, which guide the first and second rotary projections 315*a* and 315*b* to the first and second rotary guide grooves 156*a* and 156*b* when the toner container 300 is mounted, are vertically formed on the inner side surface of the vertical extension portion 152. In consideration of the shapes of the first and second rotary guide grooves 156*a* and 156*b*, as illustrated in FIG. 9, the rotating angle range of the first and second rotary projections 315*a* and 315*b* may be 90°.

The cap member 320 may be engaged with an upper end portion of the container body 310 to prevent the toner accommodated in the toner container 300 from flowing upward.

The shutter member 330 may serve to open/close the toner discharge holes 313*a* and 313*b* of the container body 310. Accordingly, first and second shutter holes 331*a* and 331*b*, which open or close the first and second toner discharge holes 313*a* and 313*b*, may be formed on the shutter member 330. A screw hole 333, which is fastened to the screw projection 316 of the container body 310, may be formed in the center of the shutter member 330. Fixing grooves, e.g., a pair of fixing grooves 332*a* and 332*b* may be formed on a bottom surface of the shutter member 330. Fixing projections, e.g., a pair of fixing projections 158*a* and 158*b* (see, for example, FIG. 10), which are elastically supported by a pair of elastic support members 159*a* and 159*b*, may be provided on a bottom surface portion 151 of the toner container mounting portion 150, and since the fixing projections 158*a* and 158*b* are inserted into the fixing grooves 332*a* and 332*b* of the shutter member 330 when the toner container 300 is mounted, the shutter member 300 is fixed without being rotated. A number of fixing projections or fixing grooves may be set to two, but alternatively, the number thereof may be changed to one, three, etc.

The shutter member 330 may be mounted on the button surface portion 311 of the container body 310 through screw fastening to the screw projection 316 of the container body 310 through the screw hole 333. Since the shutter member 330 may be mounted on the container body 310 through the screw fastening, the positions of the fixing grooves 332*a* and 332*b* of the shutter member 330 can be set to accurately correspond to the positions of the fixing projections 158*a* and 158*b* of the toner container mounting portion 150 at a time when the mounting of the shutter member 330 is completed. Accordingly, when the toner container 300 is mounted in the toner container mounting portion 150, as illustrated in FIG. 10, the fixing projections 158*a* and 158*b* can be accurately inserted into the fixing grooves 332*a* and 332*b* of the shutter member 330.

If the screw hole 333 and the screw projection 316 have no screw thread, the fixing grooves 332*a* and 332*b* of the shutter member 330 may be arranged in a certain position rather than a fixed position, and thus it may be difficult so that the fixing projections 158*a* and 158*b* are accurately inserted into the fixing grooves 332*a* and 332*b* of the shutter member 330.

As illustrated in FIG. 10, the screw projection 316 may be formed on the inner surface of the bottom surface portion 311 of the container body 310. The shutter member 330 may be arranged inside the container body 310. The screw projection 316 may be formed on the outer surface of the bottom surface portion 311 of the container body 310 as illustrated in FIG. 11. The shutter member 330 may be arranged outside the container body 310. It may not be necessary that the fixing projection through-holes 314*a* and 314*b* are formed on the bottom surface portion 311 of the container body 310.

Figure 12A:
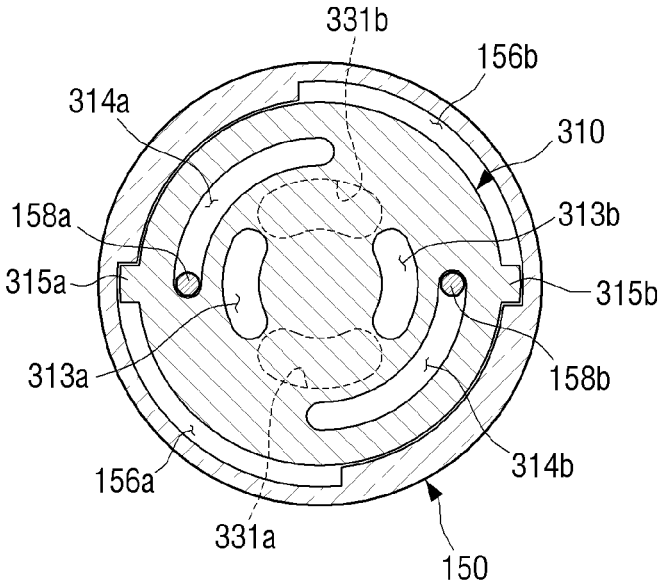
Figure 12B:
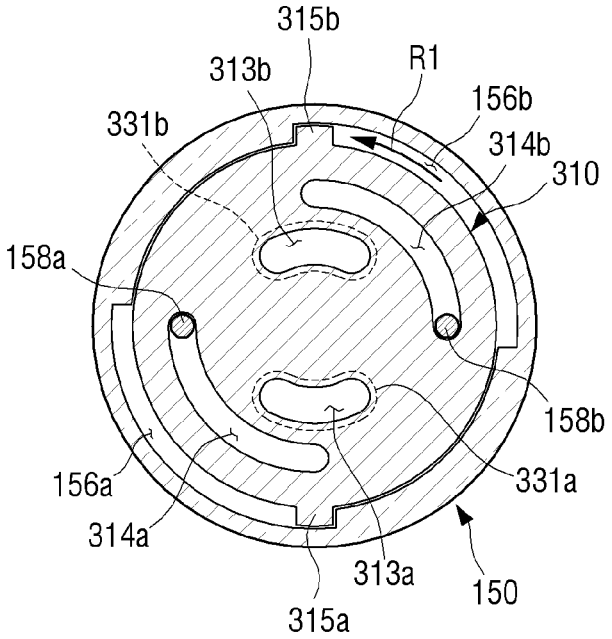

Next, FIGS. 12A and 12B are referred to.

Mounting of the toner container 300 may be performed by inserting the toner container 300 into the toner container mounting portion 150 of the main body 100 and a opening the toner discharge holes 331*a* and 331*b* through rotating of the toner container 300.

FIGS. 12A and 12B are cross-sectional views taken along line II-II of FIG. 10, in which FIG. 12A illustrates a state where insertion of the toner container (e.g., first operation) is completed in a process of mounting the toner container of FIG. 7, and FIG. 12B illustrates a state where rotation of the toner container (e.g., second operation) is completed in the process of mounting the toner container of FIG. 7.

As illustrated in FIG. 12A, if the insertion of the toner container is completed, the first and second rotary projections 315*a* and 315*b* of the container body 310 are arranged in the first and second rotary guide grooves 156*a* and 156*b* of the toner container mounting portion 150, e.g., for the first time. Since the fixing projections 158*a* and 158*b* provided on the toner container mounting portion 150 may be inserted into the fixing grooves 332*a* and 332*b* (see, for example, FIG. 8) of the shutter member 330 through the fixing projection through-holes 314*a* and 314*b* of the container body 310, the shutter member 330 may be prevented from being rotated. The toner discharge holes 313*a* and 313*b* formed on the container body 310 are kept in a closed state by the shutter member 330.

As illustrated in FIG. 12B, in the toner container rotation (second operation), the toner container 310 is rotated by 90° in the forward (R1) direction (as illustrated in the counterclockwise direction). If the second operation is completed, the first and second toner discharge holes 313*a* and 313*b* of the container body 310 are arranged in positions corresponding to positions of the first and second shutter holes 331*a* and 331*b* of the shutter member 330. That is, the first and second toner discharge holes 313*a* and 313*b* of the container body 310 are opened by the shutter member 330. Accordingly, after the second operation is completed, the toner accommodated in the toner container 300 may be discharged from the toner container 300 to be supplied to the development unit 120.

The process of separating the toner container 300 from the image forming apparatus main body 100 may be performed in reverse to the process of mounting the toner container 300. By rotating the toner container 300 by 90° in the reverse direction (in the drawing, clockwise direction), the toner discharge holes 313*a* and 313*b* are closed by the shutter member 330. Thereafter, the toner container 300 may be taken out from the toner container mounting portion 150 to complete the separation work of the toner container 300.

Since the toner container 300 may be separated from the toner container mounting portion 150 after the toner discharge holes 313*a* and 313*b* are closed by the shutter member 330, the image forming apparatus main body 100 or a user's hand is prevented from getting dirty due to the residual toner in the toner container 300 during a replacement work of the toner container 300.

Figure 13:
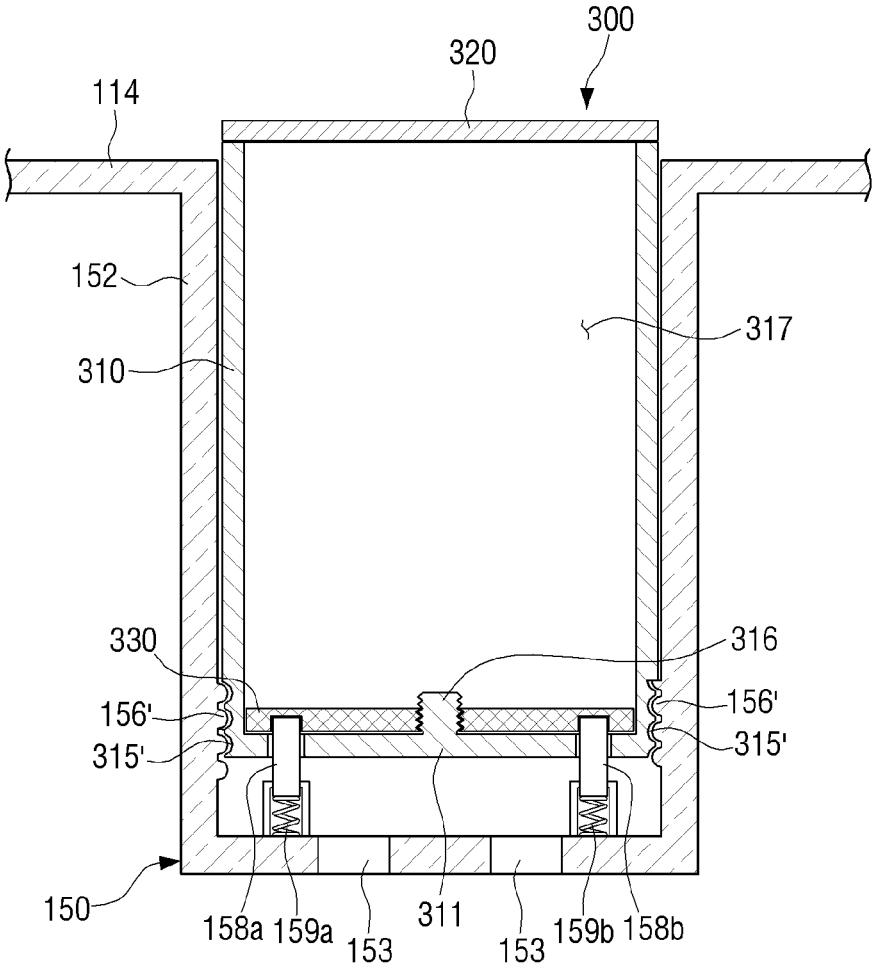
FIG. 13 is a partial cross-sectional view illustrating an exemplary toner container.

FIG. 13 is a partial cross-sectional view similar to FIG. 10 illustrating an exemplary toner container of FIG. 7.

Referring to FIG. 13, by forming a female screw thread 315' on the toner container 300 and forming a male screw thread 156' that corresponds to the female screw thread 315' on the toner container mounting portion 150, rotation of the toner container 300 can be achieved in the toner container mounting portion 150 when the toner discharge holes 313*a* and 313*b* are opened/closed. Accordingly, the rotary projections 315*a* and 315*b* (see, for example, FIG. 8), the rotary guide grooves 156*a* and 156*b*, and the vertical guide grooves 157*a* and 157*b* are not necessary.

Figure 14:
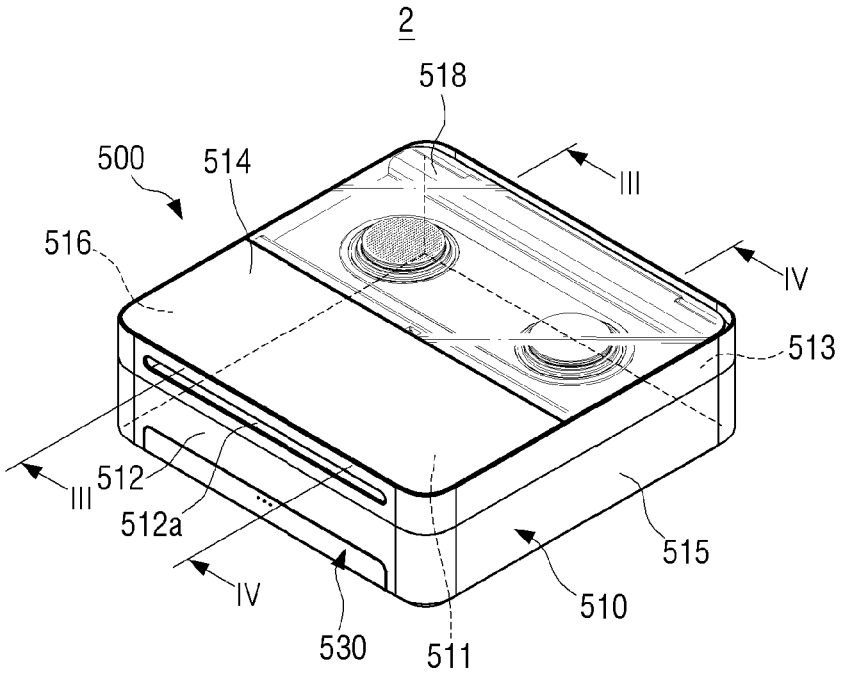
FIG. 14 is a perspective view of an image forming apparatus according to an embodiment.
Figure 15:
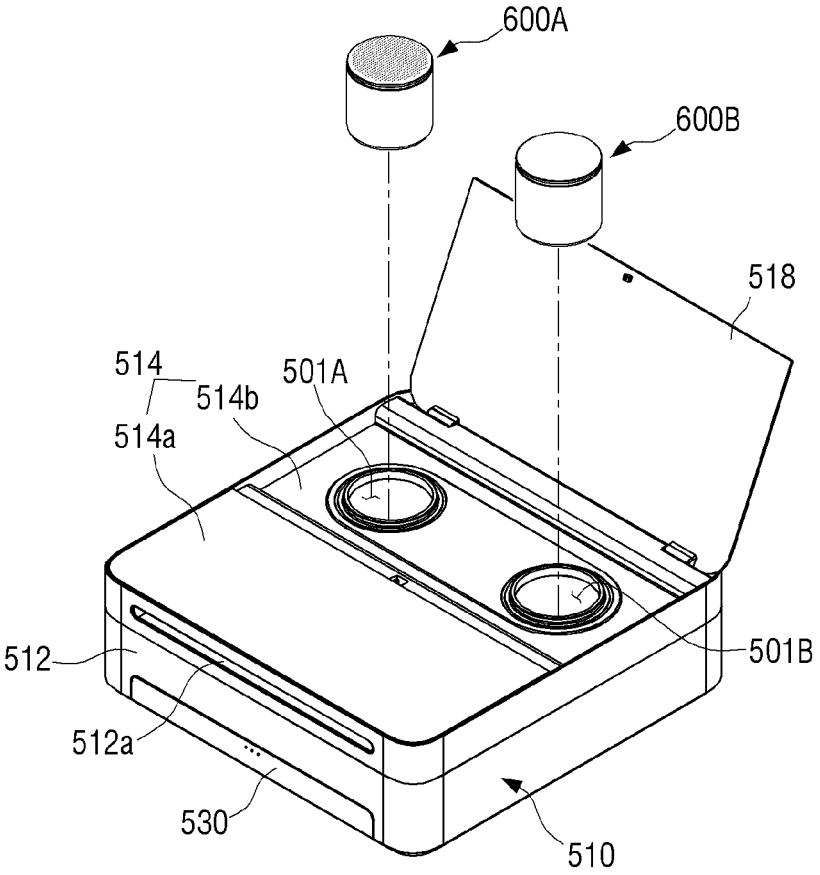
FIG. 15 is a perspective view of an exemplary image forming apparatus in a state where toner containers are separated from the image forming apparatus.

FIG. 14 is a perspective view of an image forming apparatus according to an embodiment, and FIG. 15 is a perspective view of an image forming apparatus in a state where toner container are separated from the image forming apparatus.

Referring to FIGS. 14 and 15, an image forming apparatus 2 according to an embodiment is a two-color laser printer having a relatively small size, and includes a main body 500 and a plurality, e.g., two toner containers 600A and 600B that may be separably mounted in the main body 500.

The image forming apparatus main body 500 has an external housing 510 that accommodates a plurality of internal components and forms an external appearance of the image forming apparatus 2. The external housing 510 includes bottom and upper housing portions 511 and 514 facing each other to form a bottom surface and an upper surface of the image forming apparatus 2, front and rear housing portions 512 and 513 facing each other to form a front surface and a rear surface of the image forming apparatus 2, and right and left housing portions 515 and 516 facing each other to form a right surface and a left surface of the image forming apparatus 2. The external housing 510 of the image forming apparatus main body 500 may be a simple cuboidal shape.

A paper discharge port 512*a* for discharging printed paper may be formed on an upper end portion of the front housing portion 512. A front end of a paper tray unit 530 may be exposed on a lower end portion of the front housing portion 512. A user may pull the paper tray unit 530 and then supply printing paper in the paper tray unit 530.

The upper housing portion 514 includes a front region 514*a* arranged in front and a rear region 514*b* arranged in the rear. The front and rear regions 514*a* and 514*b* may be formed with a step height so that the rear region 514*b* is arranged to be slightly deeper than the front region 514*b*. Two toner container mounting grooves 501A and 501B, which are concavely formed downward, are formed in the rear region 514*b*. A transparent or semi-transparent cover member 518 is provided on the external housing 510 to open/close the rear region 514*b*.

The two toner containers 600A and 600B may have a bottle shape. Since the two toner containers 600A and 600B may be mounted in the first and second toner container mounting grooves 501A and 501B formed on the upper housing portion 514, the toner accommodated in the toner containers 600A and 600B may be supplied into the image forming apparatus main body 500. As illustrated in FIG. 15, the first and second toner container mounting grooves 501A and 501B may be arranged in parallel to be spaced apart for a predetermined distance from each other, and thus the first and second toner containers 600A and 600B, which are mounted in the first and second toner container mounting grooves 501A and 501B, respectively, are also arranged in parallel to be spaced apart for a predetermined distance from each other.

The toner container mounting grooves 501A and 501B may be formed on a side surface portion of the main body 500, such as the left housing portion 515 or the right housing portion 516. However, in order for a user to mount the toner containers 600A and 600B in the toner container mounting grooves 501A and 501B more easily, according to an embodiment, the toner container mounting grooves 501A and 501B may be formed on the upper housing portion 514 of the main body 500.

The toner container mounting grooves 501A and 501B extend vertically downward from the upper housing portion 514. Accordingly, the toner containers 600A and 600B that are mounted in the toner container mounting grooves 501A and 501B may be arranged in the vertical direction, and the toner accommodated in the toner containers 600A and 600B can be smoothly discharged out of the toner containers 600A and 600B with the help of gravity.

Since the toner container mounting grooves 501A and 501B may be exposed to an outside through the opening of the cover member 518, the toner containers 600A and 600B can be easily accessed, and thus the mounting or separation work of the toner containers 600A and 600B can be conveniently performed.

The toner containers 600A and 600B have a length for which at least a part thereof is exposed out of the toner container mounting grooves 501A and 501B in a state where the toner containers 600A and 600B are mounted in the toner container mounting grooves 501A and 501B. Further, upper end portions (e.g., cap portions) of the toner containers 600A and 600B may be provided to have the same color as the color of the accommodated toner. Accordingly, the user can easily identify the kind of the toner containers mounted in the image forming apparatus 2.

The two toner containers 600A and 600B accommodate toners, e.g., having different colors. The first toner container 600A may accommodate toner of a black color, and the second toner container 600B may accommodate toner of a highlight color that is different from the black color. For example, a red color toner that is used for highlight may be accommodated in the second toner container 600B. However, the present disclosure is not limited thereto, and toner having another color (e.g., blue toner, green toner, or yellow toner) that can be used for highlight may be accommodated in the second toner container 600B.

Since toner of a black color that is a basic color and toner of a red color that is a color for highlight may be provided by the two toner container 600A and 600B, not only monochrome printing but also highlight-added monochrome printing can be performed by the image forming apparatus 2.

The respective toner container 600A and 600B may have an exemplary structure of the first type toner container 200 illustrated in FIG. 2 and a second type toner container 300 illustrated in FIG. 7. Accordingly, in a similar manner as the toner containers 200 and 300 the image forming apparatus main body 500 or a user's hand is prevented from getting dirty due to the residual toner in the toner containers 600A and 600B during the replacement work of the toner containers 600A and 600B.

Figure 16A:
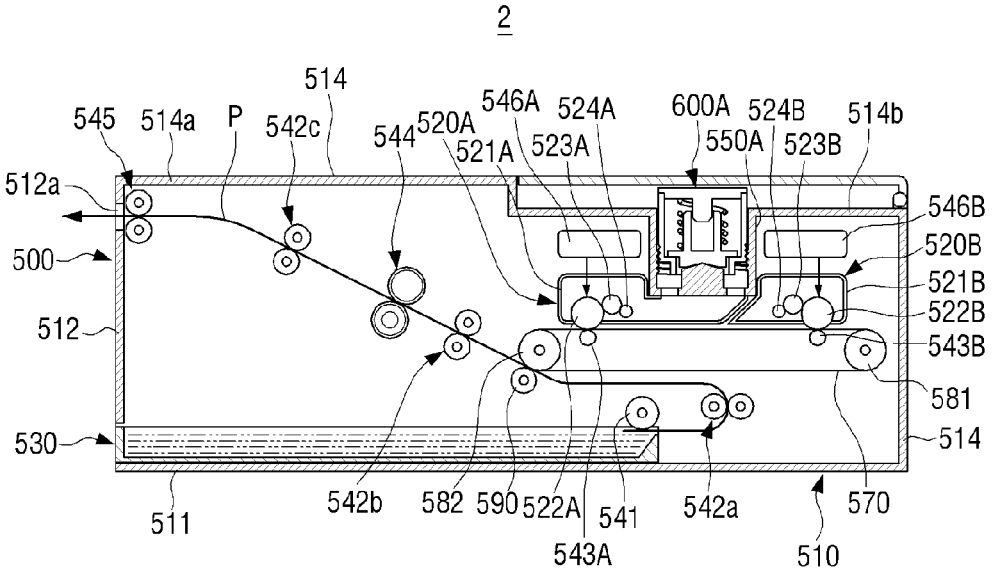
FIG. 16A is an exemplary cross-sectional view taken along line III-III of FIG. 14.
Figure 16B:
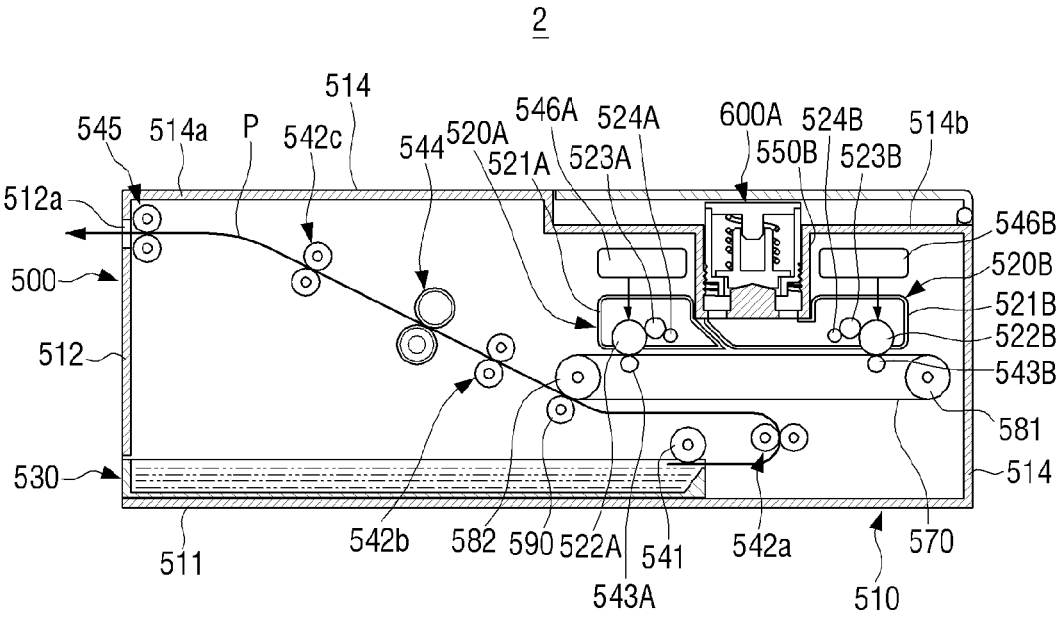
FIG. 16B is an exemplary cross-sectional view taken along line IV-IV of FIG. 14.

FIG. 16A is an exemplary cross-sectional view taken along line III-III of FIG. 14, and FIG. 16B is a cross-sectional view taken along line IV-IV of FIG. 14.

Referring to FIGS. 16A and 16B, the image forming apparatus main body 500 accommodates components, such as first and second development units 520A and 520B, a pickup unit 541, a plurality of conveyor units 542*a*, 542*b*, and 542*c*, first and second primary transfer rollers 543A and 543B, a secondary transfer roller 590, a transfer belt 570, a fixing unit 544, a discharge unit 545, and first and second exposure units 546A and 546B.

The first development unit 520A is a development unit that corresponds to the first toner container 600A, and includes a development unit casing 521A, a photosensitive drum 522A accommodated in the casing, a development roller 523A, and a supply roller 524A. The second development unit 520B is a development unit that corresponds to the second toner container 600B, and includes a development unit casing 521*b*, a photosensitive drum 522B accommodated in the casing, a development roller 523B, and a supply roller 524B. The transfer belt 570 may be rotatably supported by a drive roller 581 and an idle roller 582.

Components of the image forming apparatus 2 are disclosed.

A printing process that is performed by the image forming apparatus 2 along a paper path P is described. If a print job starts, electrostatic latent images that reflect image data are formed on the respective photosensitive drums 522A and 522B by laser lights provided from the exposure units 546A and 546B, and the electrostatic latent images are developed into toner images by the development rollers 523A and 523B. The developed toner images are primarily transferred onto the rotating transfer belt 570. The printing paper is picked up by the pickup unit 541, and passes between the idle roller 582 and the secondary transfer roller 590 to receive secondary transfer of the toner images that are transferred onto the transfer belt 570. Thereafter, the printing paper is discharged out of the main body 500 through the paper discharge port 512*a* after passing through an image fixing process that is performed by the fixing unit 544.

Two toner container mounting portions 550A and 550B may be formed on the upper housing portion 514 of the main body 500.

As illustrated in FIG. 16A, the first toner container mounting portion 550A has the first toner container mounting groove 501A (see, for example, FIG. 15) as described above, and vertically extends from the upper housing portion 514 into the main body 500. The first toner container mounting portion 550A communicates with the development unit casing 521A of the first development unit 520A. Accordingly, if mounting of the first toner container 600A in the first toner container mounting portion 550A is completed, toner of a black color, which is accommodated in the first toner container 500A, may be supplied into the first development unit 520A through the first toner container mounting portion 550A.

As illustrated in FIG. 16B, the second toner container mounting portion 550B has the second toner container mounting groove 501B (see, for example, FIG. 15), and vertically extends from the upper housing portion 514 into the main body 500. The second toner container mounting portion 550B communicates with the development unit casing 521B of the second development unit 520B. Accordingly, if mounting of the second toner container 600B in the second toner container mounting portion 550B is completed, toner of a highlight color, which is accommodated in the second toner container 500B, may be supplied into the second development unit 520B through the second toner container mounting portion 550B.

According to an embodiment, the respective toner container mounting portions 550A and 550B may be configured to form a part of the upper housing portion 514. As an alternative, the respective toner container mounting portions 550A and 550B may be configured to form a part of the corresponding development unit casings 521A and 521B.

While the disclosure has been shown and described with reference to certain embodiments thereof, it will be understood by those skilled in the art that various changes in form and detail may be made therein without departing from the spirit and scope of an exemplary embodiment.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. An image forming apparatus comprising:

an image forming apparatus main body;

first and second toner containers mounted in the image forming apparatus main body; and wherein the first and second toner containers are respectively mounted in first and second toner container mounting grooves that are concavely formed in a housing portion of the image forming apparatus main body and vertically extend with respect to the housing portion, wherein first and second toner container mounting portions have at least one toner outflow hole to outflow toner, respectively, and wherein the at least one toner outflow hole is opened as at least one of the toner container mounting portions is screw-connected to the toner container and the toner outflow hole is closed as at least one of the toner container mounting portions is separated from the toner container.

2. The image forming apparatus as claimed in claim 1, wherein a color of toner accommodated in the first toner container is different from a color of toner accommodated in the second toner container.

3. The image forming apparatus as claimed in claim 2, wherein the toner accommodated in the first toner container is a toner of a black color, and the toner accommodated in the second toner is a toner of a highlight color.

4. The image forming apparatus as claimed in claim 1, wherein the first toner container mounting groove and the second toner container mounting groove are arranged in parallel to be spaced apart from each other.

5. The image forming apparatus as claimed in claim 1, wherein the containers are bottle-shaped and each of the toner containers is mounted in each of the toner container mounting grooves so that at least a part of the toner container is exposed out of the image forming apparatus main body.

6. The image forming apparatus as claimed in claim 1, wherein each of the toner container mounting grooves are formed in an upper housing portion of the image forming apparatus main body and extends vertically downward from the upper housing portion.

7. The image forming apparatus as claimed in claim 1, wherein each of the toner container mounting portions includes:

a vertical extension portion configured to vertically extend from a bottom surface portion toward an upper housing portion of the image forming apparatus main body.

8. The image forming apparatus as claimed in claim 7, wherein each of the toner containers comprises:

a container body on which at least one toner discharge hole is formed, and a shutter member mounted on the container body so as to be arranged in a first position to close the toner discharge hole or in a second position to open the toner discharge hole.

9. The image forming apparatus as claimed in claim 8, wherein the shutter member is slidable between the first position and the second position in the container body.

10. The image forming apparatus as claimed in claim 9, wherein each of the toner containers further comprises an elastic pressing member configured to elastically press the shutter member in the first direction, and the bottom surface portion of the toner container mounting portion has a pressing projection configured to press the shutter member in the second direction when the corresponding toner container is mounted.

11. The image forming apparatus as claimed in claim 10, wherein the shutter member comprises:

a plate-shaped shutter portion configured to close the toner discharge hole when the shutter member is arranged in the first position, an elastic member support portion formed to project from an upper surface of the shutter portion to support the elastic pressing member, and a pressed portion formed to project from a lower surface of the shutter portion to be pressed by the pressing projection when the toner container is mounted.

12. The image forming apparatus as claimed in claim 8, wherein the container body is mounted on the toner container mounting portion to be bidirectionally rotatable in a predetermined angle range, and an arrangement of the shutter member is shifted from the first position to the second position by a forward rotation of the container body, and is shifted from the second position to the first direction by a reverse rotation of the container body.

13. The image forming apparatus as claimed in claim 12, wherein at least one toner discharge hole is formed on a bottom surface portion of the container body, and at least one shutter hole, which is arranged corresponding to the at least one toner discharge hole in the second position, is formed on the shutter member.

14. The image forming apparatus as claimed in claim 12, wherein at least one fixing projection for fixing the shutter member is provided on the toner container mounting portion, and at least one fixing groove, into which the fixing projection is inserted, is formed on a bottom surface of the shutter member.

15. The image forming apparatus as claimed in claim 14, wherein the fixing projection is elastically supported upward by an elastic support member provided on the toner container mounting portion.

16. The image forming apparatus as claimed in claim 12, wherein a screw projection is formed on a bottom surface portion of the container body, and a screw hole that is screw-fastened to the screw projection is formed on the shutter member.

17. The image forming apparatus as claimed in claim 12, wherein at least one rotary projection is formed on a side surface portion of the container body, and at least one rotary guide groove that guides rotation of the rotary projection is formed on an inner side surface of the toner container mounting portion.

18. The image forming apparatus as claimed in claim 17, wherein at least one vertical guide groove is formed on an inner side surface of the vertical extension portion to guide the rotary projection from the upper housing portion to the rotary guide groove when the toner container is mounted.

19. An image forming apparatus comprising:

an image forming apparatus main body; and first and second toner containers mounted in the image forming apparatus main body, wherein the first and second toner containers are respectively mounted in first and second toner container mounting grooves that are concavely formed in a housing portion of the image forming apparatus main body and vertically extend with respect to the housing portion, and wherein a cover member for covering the first and second toner containers is openably mounted in the image forming apparatus main body.

20. An image forming apparatus as claimed in claim 19, wherein the cover member is formed of a transparent or semi-transparent material.

* * * * *